US005628238A

United States Patent [19]

Elsworth

[11] Patent Number: 5,628,238

[45] Date of Patent: May 13, 1997

[54] HYDRAULIC ACTUATOR FOR ISOLATORS

[75] Inventor: Leslie W. Elsworth, Sheffield, United Kingdom

[73] Assignee: WES Technology Inc., Santa Ana, Calif.

[21] Appl. No.: 481,444

[22] PCT Filed: Dec. 22, 1993

[86] PCT No.: PCT/GB93/02628

§ 371 Date: Aug. 18, 1995

§ 102(e) Date: Aug. 18, 1995

[87] PCT Pub. No.: WO94/15104

PCT Pub. Date: Jul. 7, 1994

[30] Foreign Application Priority Data

Dec. 23, 1992 [GB] United Kingdom ..... 9226773

[51] Int. Cl.[6] ..... F01B 29/00

[52] U.S. Cl. ..... 92/161; 92/DIG. 1

[58] Field of Search ..... 92/161, DIG. 1, 92/140; 137/385; 251/58

[56] References Cited

U.S. PATENT DOCUMENTS

| | | | |
|---|---|---|---|
| 3,096,077 | 7/1963 | Forsyth | 92/161 X |
| 3,967,539 | 7/1976 | Williamson | 92/161 X |
| 4,039,419 | 8/1977 | Buse | 204/225 |
| 4,453,455 | 6/1984 | Bergstrand | 92/140 X |
| 4,550,571 | 11/1985 | Bertsch | 92/140 X |
| 5,109,883 | 5/1992 | Squirrell | 137/385 |
| 5,429,153 | 7/1995 | Squirrell | 137/385 |

FOREIGN PATENT DOCUMENTS

| | | |
|---|---|---|
| 1401605 | 2/1974 | United Kingdom . |
| 8911612 | 11/1989 | WIPO . |
| 9208056 | 5/1992 | WIPO . |

*Primary Examiner*—Hoang Nguyen

*Attorney, Agent, or Firm*—Gottlieb, Rackman & Reisman, P.C.

[57] ABSTRACT

A hydraulic actuator for an isolator such as a diverter valve, the actuator comprising a hydraulic ram (1) one end of which is connected to a lever (2) which is in turn connected to a shaft (3) for a valve plate or other closure. The basic novel characteristic of the actuator is that the end of the actuator frame remote from the shaft is connected to the isolator frame by means of a torque arm reaction anchor (4) so as to prevent the actuator from rotating with the shaft.

6 Claims, 3 Drawing Sheets

HYDRAULIC ACTUATOR FOR ISOLATORS

This invention relates to a hydraulic actuator for isolators, in particular for diverter valves or flap isolators (herein both referred to as isolators) used for isolating gases under severe operating conditions of high temperature and/or high pressure.

BACKGROUND OF THE INVENTION

For many diverter valve or flap isolator applications it is necessary or desirable to use hydraulic actuation systems.

Conventional hydraulic actuation systems usually consist of a hydraulic ram operating a lever which is connected to a shaft to be rotated, to which a valve closure plate is attached. The base end of the ram is pin jointed to an anchor bracket which is normally rigidly fixed to some point of the damper or isolator frame. The disadvantage of this arrangement is that differences in temperature between the isolator frame (hot) and the hydraulic ram (cold) causes the effective length of the ram link system and hence the position of the blade to change.

PCT patent application no. PCT/GB89/00593 (publication no. WO 89/11612) corresponding to U.S. Pat. No. 5,109,883 describes and claims an improved hydraulic actuator for overcoming such disadvantages. Specifically, the invention disclosed in the said WO 89/11612 provides a hydraulic actuator for an isolator, comprising a hydraulic ram one end of which is connected to a lever which is in turn connected to a shaft for a valve plate or other closure, the actuator having a casing which flange mounts on the isolator, and the other end of the said ram being attached to the end of the casing remote from the said flange.

The increasing size of gas turbines creates the need for larger diverter valves for directing the flow of products of combustion to boiler or by pass for combined cycle plant. Larger diverter valves require greater torque. One method of providing this torque is by means of the hydraulic actuator which is the subject of the above-mentioned WO 89/11612 and its corresponding U.S. patent.

The operating thrust for this particular actuator is provided by a single hydraulic ram. By the very nature of this arrangement the ram not only transmits the desired torque, but imposes on the overhung shaft a bending moment and also a corresponding radial load upon the bearing.

BRIEF DESCRIPTION OF THE INVENTION

The present invention provides a hydraulic actuator for an isolator such as a diverter valve, the actuator comprising a hydraulic ram one end of which is connected to a lever which is in turn connected to a shaft for a valve plate or other closure, wherein the end of the actuator frame remote from the shaft is connected to the isolator frame by means of a torque arm reaction anchor so as to prevent the actuator rotating with the shaft.

The actuator according to the present invention significantly overcomes the disadvantages of the above-mentioned known actuator according to WO 89/11612, of large bending moment on the overhung shaft and corresponding radial load upon the bearing.

In the present invention the actuator is shaft mounted and the torque reaction is taken up by the torque arm anchor. In comparison with the actuator of WO 89/11612, for a given torque the bending moment transmitted to the shaft and radial load transmitted to the bearings are reduced by about 80%. This is due to the fact that in the system of the present invention the torque reaction forces are reacted at a much greater effective lever arm length than they are in the case of the actuator of WO 89/11612, as will be described in more detail below with reference to the accompanying drawings.

The general construction of the actuator according to the present invention is similar to that of the actuator of WO 89/11612, but does not have a mounting flange. Instead the end of the casing opposite to the shaft has a torque arm reaction anchor.

In one embodiment of the actuator according to the present invention, the torque arm reaction is taken by sliding members which are free to slide over a tongue of a bracket, which tongue is to be mounted on the diverter valve frame via the torque arm anchor.

In an alternative, preferred, embodiment of the actuator according to the present invention, the torque arm reaction is taken by a restraining link with spherical bearings at each end to cater for changes in the relative position of the end of the actuator and the attachment point to the diverter valve frame. The link can be made adjustable in length to improve the ease of adjustment.

In addition to the characterising feature of the present invention that the end of the actuator frame remote from the shaft is connected to the isolator frame by a torque arm reaction anchor, it is preferred that the lever arm is keyed to the diverter valve shaft, and to each end of the outer diameter of the lever arm boss are fitted bushes to which are applied a bearing surface of low friction, non-lubricated, bearing material. The housing preferably has two bushes in which the bearings mounted on the lever arm rotate.

Attention is also drawn to the hydraulic actuator for an isolator as described and claimed in PCT patent application no. PCT/GB91/01876 (WO 92/08056) corresponding to U.S. Pat. No. 5,429,153, which provides two identical rams operating in opposite directions, wherein the radial load exerted by the one ram is equal in magnitude but opposite in direction to the other. The alignment of rams and actuating arm is such that the thrusts for a given direction of rotation are equal and opposite, thus eliminating the bending moment on the overhung shaft of the isolator. The structures according to the present invention could also be applied to double ram actuators of the type described in WO 92/08056, although there are less compelling reasons for doing so as the radial loads are minimised.

BRIEF DESCRIPTION OF THE DRAWINGS

The invention will be further described, by way of example only, with reference to the accompanying drawings, in which.

DETAILED DESCRIPTION OF THE INVENTION

Figure 1:
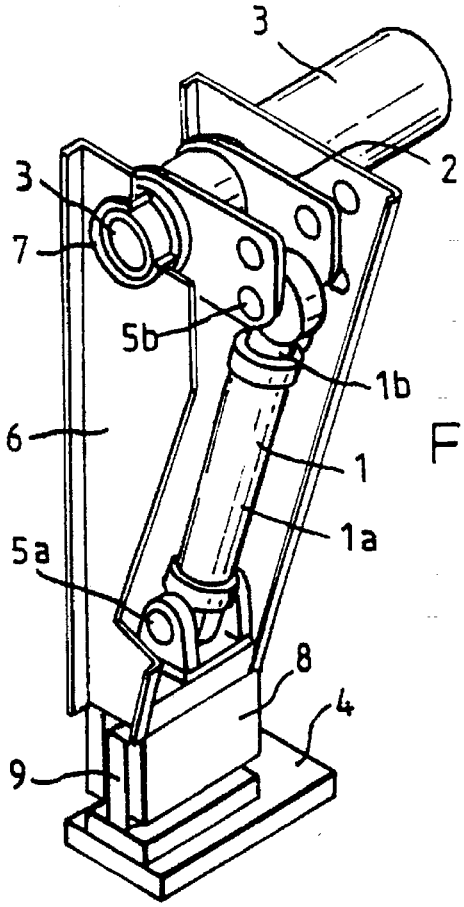
FIG. 1 is a perspective view showing one embodiment of a shaft mounted hydraulic actuator, for a diverter valve, according to the invention.

The hydraulic actuator shown in FIG. 1 comprises a hydraulic ram 1 having a cylinder 1*a* and a rod 1*b*, the end of the ram 1 being connected to a lever arm assembly 2 which is in turn connected to a through shaft 3 for a valve plate or other closure (not shown) of a diverter valve isolator. The end of the ram 1 remote from the shaft 3 (the base end of the ram) is connected to the diverter valve frame (not shown in FIG. 1) via the actuator frame by means of a torque arm reaction anchor 4. The ram 1 is pivotably connected to the anchor 4 by a pin joint 5*a*, and the rod end of the ram is connected to the lever arm assembly 2 by another pin joint 5*b*. The actuator parts 1, 2 and 5 are enclosed in a casing 6.

A bearing or bearings 7 on the actuator casing 6 contain(s) cylinder loads within the actuator frame.

In the present invention the actuator is shaft mounted and the torque reaction is taken up by the torque arm anchor 4. In the embodiment of FIG. 1 the torque arm reaction is taken up by sliding members 8 which are free to slide over a tongue 9 of a bracket, which tongue 9 is mounted on the diverter valve frame via the torque arm anchor 4, thus allowing movement in the direction parallel to the bracket.

The general construction of the actuator of the present invention as shown in FIG. 1 is similar to that of the actuator of WO 89/11612, but does not have a mounting flange by means of which an actuator casing is mounted on the isolator. Instead, in the present invention, the end of the frame 6 opposite to the shaft 3 has a torque arm reaction anchor 4 itself connected to the isolator frame.

Figure 2A:
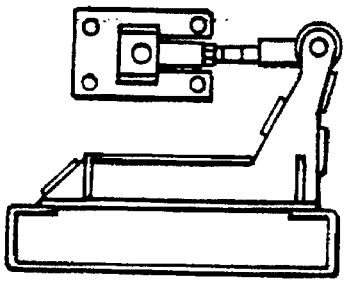
FIG. 2*a* is a view taken in the direction of the arrow A in FIG. 2, with the actuator body omitted for reasons of clarity.
Figure 2:
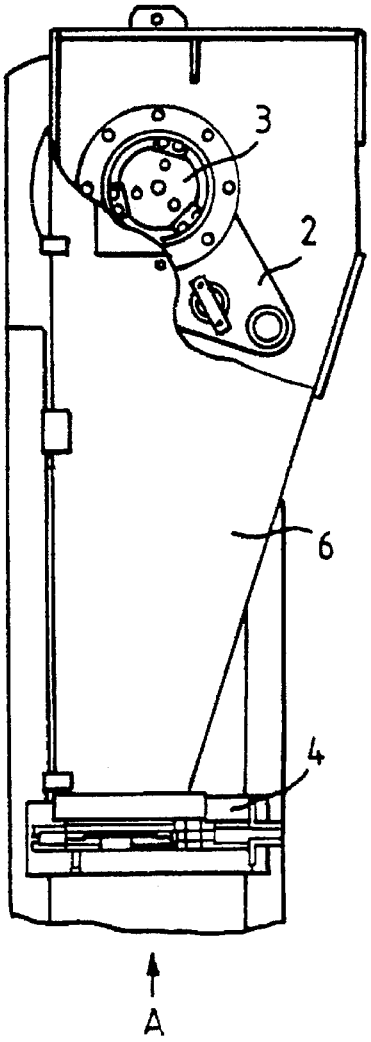
FIG. 2 is a side view showing another embodiment of a shaft mounted hydraulic actuator, for a diverter valve, according to the invention.
Figure 3:
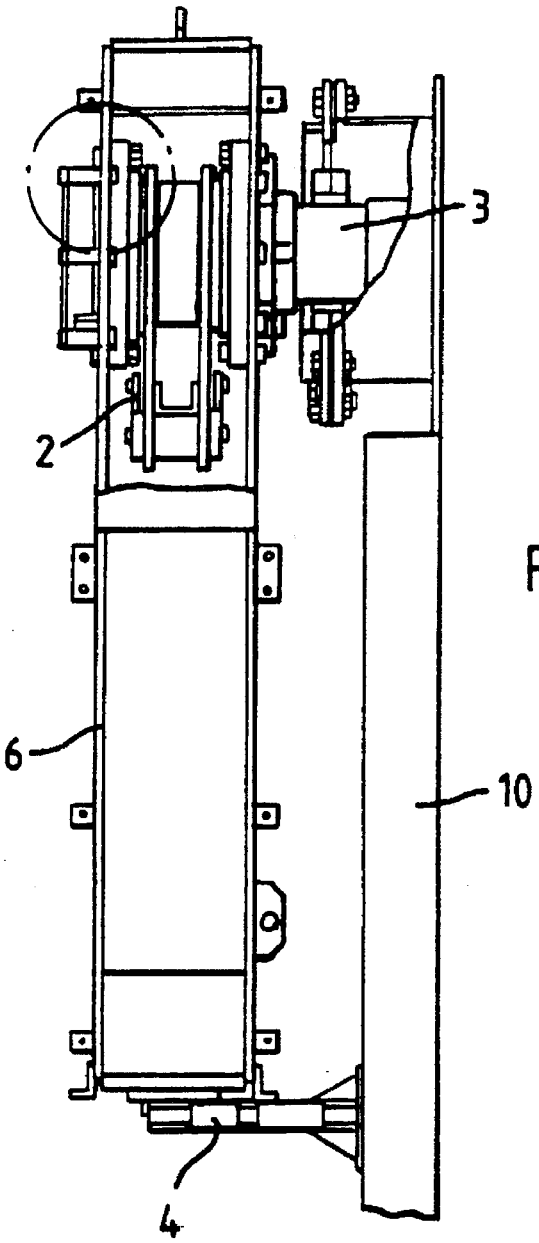
FIG. 3 is an end view of a modified form of an hydraulic actuator, with the actuator cylinder omitted for reasons of clarity.

In the embodiments shown in FIGS. 2 and 3, like parts as in the embodiment of FIG. 1 have been indicated by like reference numerals, and will therefore not be further described as such.

In the embodiment shown in FIGS. 2 and 2*a*, the torque arm reaction is taken by a restraining link with spherical bearings at each end to cater for changes in the relative position of the end of the actuator and the attachment point to the diverter valve frame (indicated in FIG. 3 by reference numeral 10). The link can be made adjustable in length to improve the ease of adjustment. The link is shown in more detail in FIG. 2*a*.

Figure 3A:
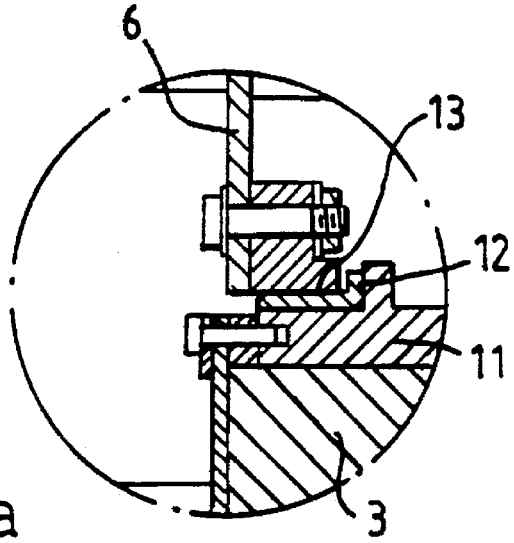
FIG. 3*a* shows in detail the area marked in FIG. 3.

In the embodiment shown in FIGS. 3 and 3*a*, the lever arm 2 is keyed to the diverter valve shaft 3, and to each end of the outer diameter of the lever arm boss 11 are fitted bushes 12 to which are applied a bearing surface 13 of low friction, non-lubricated, bearing material. The housing preferably has two bushes in which the bearings mounted on the lever arm rotate. The bearing arrangement is shown in detail in FIG. 3*a*.

The actuator according to the invention as described above with reference to the embodiments of FIGS. 1 to 3 overcomes the disadvantages of the actuator according to WO 89/11612 of large bending moment on the overhung shaft and corresponding radial load upon the bearing. The actuator according to the present invention is shaft mounted and the torque reaction is taken up by the torque arm anchor. In comparison with the actuator of WO 89/11612 which is flange mounted, for a given torque the bending moment transmitted to the shaft and radial load transmitted to the bearings are reduced by about 80%. This is due to the fact that in the system of the present invention the torque reaction forces are reacted at a much greater effective lever arm length than is the case for the actuator of WO 89/11612, as will be explained in more detail with reference to FIGS. 4*a*–4*b* and 5*a*–5*b*–5*c*.

Figure 4A:
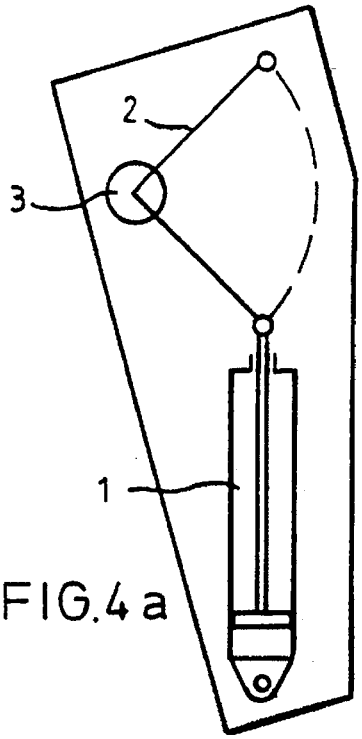
FIGS. 4*a* and 4*b* are schematic views illustrating the loading and effective arm length of a hydraulic actuator of the prior art, of the type described in WO 89/11612.
Figure 4B:
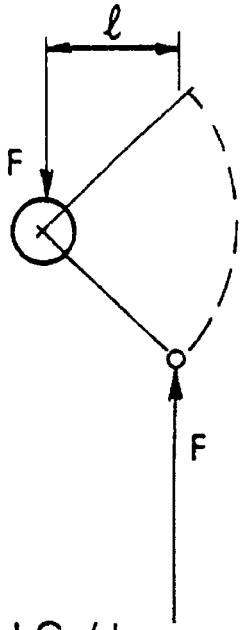

FIGS. 4*a* and 4*b* represent the forces acting on an actuator of the type according to WO 89/11612, wherein the effective lever arm length (at the end of the stroke) is l, the ram thrust is F, the reaction at the shaft is F, and the torque is Fl.

It will be apparent that, applying the conditions required for equilibrium, for the hydraulic actuator according to WO 89/11612 which is flange mounted, in that the actuator has a casing which flange mounts on the isolator and the end of the ram remote from the shaft is attached to the end of the casing remote from the flange, the actuator body is thus rigidly fixed to the diverter valve body, in terms of both position and resistance to rotation, at the flange (i.e., at the element which is designated by reference numeral 1*a* in FIG. 2 of WO 89/11612). As will be apparent from FIGS. 4*a* and 4*b*, the shaft reaction is equal in magnitude and opposite in direction to the ram thrust, while the torque reaction is taken at the actuator flange.

Figure 5A:
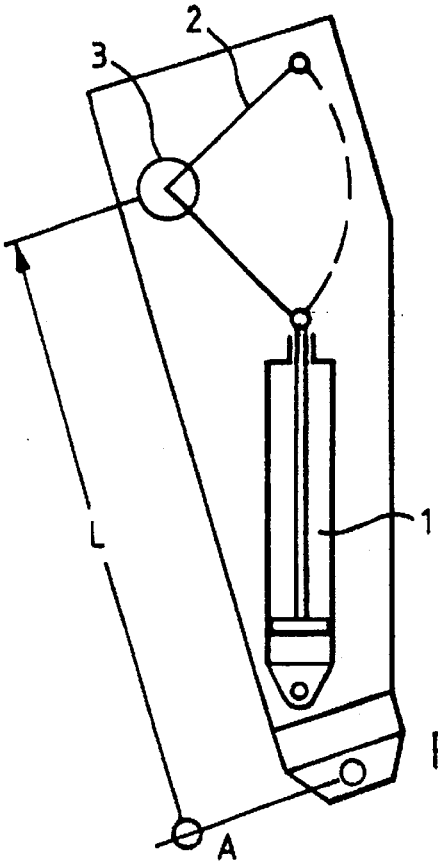
FIGS. 5*a*, 5*b* and 5*c* are schematic views illustrating the loading and effective arm length of a hydraulic actuator according to the present invention.
Figure 5B:
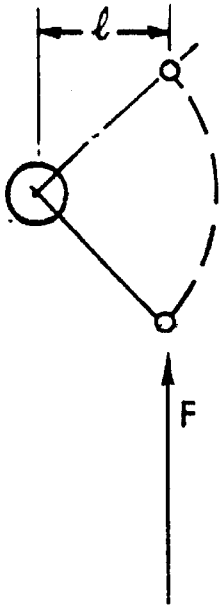
Figure 5C:
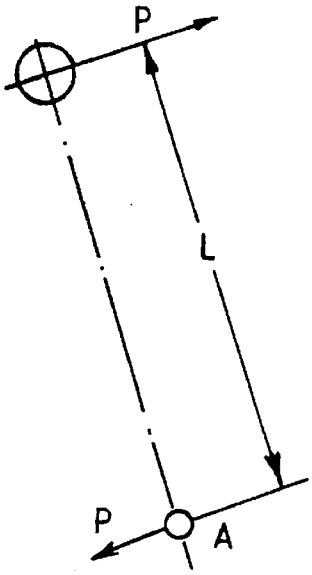

FIGS. 5*a*, 5*b* and 5*c* represent the forces acting on an actuator according to the present invention, wherein the effective lever arm length at the end of the stroke is l, the ram thrust is F, and the torque is Fl. However, since the distance from the shaft to the anchor point A is L as shown, the reaction at the anchor point equals the reaction P at the shaft, that is $$P=\frac{Fl}{L},$$

which is much less than F.

Thus in the case of the shaft mounted actuator according to the present invention, the two fixing functions are entirely separated, so that the actuator body is fixed in position by its location on and connection to the shaft itself and is constrained from rotation only by the connection at the anchor point. This point therefore resists the torque reaction, and the load on the shaft is equal in magnitude and opposite in direction to the load at that point. As the distance between the shaft center and the point of attachment of the anchor is much greater than the effective length of the actuator lever arm, the load at the shaft is reduced by a factor (l/L).

I claim:

1. An isolator, comprising an isolator frame, an isolator shaft having an axis and journaled in said isolator frame for rotational movement relative thereto about said axis, and an isolator closure member carried by said isolator shaft for movement therewith; a hydraulic actuator for said isolator shaft, said hydraulic actuator comprising an actuator frame having first and second ends, with a part of said isolator shaft extending into said first end of said actuator frame, a lever connected to said part of said isolator shaft in the region of said first end of said actuator frame, and a hydraulic ram arranged in said actuator frame, said ram having one end connected to said lever adjacent said first end of said actuator frame proximate to said isolator shaft, and another end connected to said actuator frame in the region of said second end of said actuator frame remote from said isolator shaft; and a torque arm reaction anchor operatively interconnected between said other end of said actuator frame remote from said isolator shaft and said isolator frame for enabling said torque arm reaction anchor to prevent said actuator from rotating with said isolator shaft.

2. An isolator as claimed in claim 1, wherein said torque arm reaction anchor includes a bracket rigidly connected to said isolator frame, a tongue which extends from and is rigidly connected to said bracket, and a pair of spaced sliding members which are carried by said actuator frame adjacent said other end thereof remote from said isolator shaft, said tongue being received in the space between said sliding members which are in sliding engagement with opposite faces of said tongue and hence are free to slide over said tongue, whereby the torque arm reaction is taken by said sliding members, said tongue and said bracket.

3. An isolator as claimed in claim 1, wherein said torque arm reaction anchor includes a restraining link having opposite ends connected to said isolator frame and said actuator frame, respectively, said restraining link being provided at each of said opposite ends thereof with spherical bearings for accommodating changes in the relative positions of said second end of said actuator frame and the attachment point to said isolator frame.

4. An isolator as claimed in claim 3, wherein said restraining link further includes means for adjusting the length of said restraining link to improve the ease of adjustment of the interconnection between said actuator frame and said isolator frame.

5. An isolator as claimed in claim 1, wherein said lever is keyed to said isolator shaft, said lever includes a lever arm boss, and to each end of the outer diameter of said lever arm boss are fitted a respective bush to which is applied a bearing surface of low friction, non-lubricated, bearing material.

6. An isolator as claimed in claim 5, further comprising two bushes in which respective bearings mounted on said lever arm rotate.

* * * * *